United States Patent [19]

von der Eltz et al.

[11] 4,439,881

[45] Apr. 3, 1984

[54] PROCESS FOR THE CONTINUOUS UNIFORM APPLICATION OF DYE LIQUORS TO WET TEXTILE FABRIC WEBS

[75] Inventors: Hans-Ulrich von der Eltz, Frankfurt am Main; Peter Oppitz, Kelkheim, both of Fed. Rep. of Germany

[73] Assignee: Hoechst Aktiengesellschaft, Frankfurt am Main, Fed. Rep. of Germany

[21] Appl. No.: 306,876

[22] Filed: Sep. 29, 1981

[30] Foreign Application Priority Data

Oct. 1, 1980 [DE] Fed. Rep. of Germany ..... 3037156

[51] Int. Cl.[3] ..... D06B 23/26

[52] U.S. Cl. ..... 8/151; 8/158; 68/13 R

[58] Field of Search ..... 8/151, 158; 68/13 R, 68/22 R, 212; 162/DIG. 6, DIG. 10, 252

[56] References Cited

U.S. PATENT DOCUMENTS

| | | | |
|---|---|---|---|
| 2,922,475 | 1/1960 | Alexander | 162/DIG. 6 |
| 3,811,834 | 5/1974 | Schwemmer et al. | 8/158 X |
| 4,157,595 | 6/1979 | von der Eltz et al. | 8/151 |

*Primary Examiner*—Philip R. Coe

*Attorney, Agent, or Firm*—Curtis, Morris & Safford

[57] ABSTRACT

In order to maintain at a constant value the quantity of liquor applied in the wet-on-wet application of two liquors of differing composition, it is necessary that the fabric web which is wet from the preceding wet treatment is first uniformly partially dewatered and the second liquor is then applied uniformly. By using high-moisture measuring instruments after the dewatering and also controlling the same with the aid of measured values, and by proceeding similarly after the repeated application of liquor, it is possible to stay within the tolerances which are necessary to ensure the uniformity of the two processes.

12 Claims, No Drawings

PROCESS FOR THE CONTINUOUS UNIFORM APPLICATION OF DYE LIQUORS TO WET TEXTILE FABRIC WEBS

The present invention relates to a process for the continuous uniform application of aqueous dye liquors to water-wet textile fabric webs, whose moisture content is measured, using the principle of microwave absorption, by an apparatus arrangement which has more than two measuring positions across the width of the web, before the application of liquor and, by a further measuring arrangement which consists of the same equipment as before, after the application of the liquor, continuously and contactfree, in the longitudinal and in the transverse direction with respect to the passage of the fabric.

In continuous dyeing by customary methods the dye liquors are as a rule applied to dry fabric webs. However, because this circumstance is in general customary and therefore self-evident, it is not particularly emphasized in the technical literature. In this instance, uniform application of liquor requires good pretreatment of the dye goods by, for example, the consecutive process steps of singeing, desizing, boiling-off, bleaching and washing, namely processes which require a wet treatment. Following these, the goods consequently hitherto always had to be dried in such cases.

All the while a number of dyeing methods have become known under the term "wet-in-wet" process or "wet-on-wet" process, in which a chemical liquor, fixing agent liquor or development liquor is applied in a second padding step to a fabric web which has been padded with a dye liquor or bottoming liquor in a first padding step. In this case, two padding liquors of differing composition are applied consecutively.

However, methods based on the mentioned principle, with two-fold differing application of liquor, have not been successful, because the second application of liquor differed from the first application of liquor in that the quantities applied fluctuated too strongly and uncontrollably. Therefore, the Journal Internationales Textil-Bulletin (Färberei) 3/78, pages 261–262, carried a recommendation to overcome the highlighted difficulties in wet-on-wet product application by the use of a high-moisture measuring instrument based on microwaves. In the case mentioned a measuring position is located before, and a second measuring position is located after, the second application of liquor, and the moisture recorded at the first position is compared with the value indicated at the second position. The resulting moisture difference value is used for controlling the second application of liquor. Thus, maintaining the amount of liquor applied at a constant value is more or less certainly ensured.

However, for all known wet-on-wet processes it must be taken into consideration that the dyestuff or dyestuff component which governs the levelness of the dyeing has always been applied to the dry fabric web; this is also true for the process just described, which is based on moisture measurement with the aid of microwave absorption.

It has now been found that the above-described measurement of fabric moisture in the high-moisture region, which is carried out according to the principle of microwave absorption, and the control of the application of liquor which makes use of this moisture content determination, can be used for dispensing with a drying step.

Accordingly, the object of the present invention is to dewater a wet fabric web continuously, without drying it, and uniformly, so as to give a desired or required residual moisture content and then to apply a dye liquor uniformly onto the uniformly moist fabric web. The new process is primarily intended to dispense with a drying process after the pretreatment of the fabric web.

This object is achieved according to the invention by partially and uniformly dewatering a fabric web which is wet from a preceding wet treatment so as to give a certain residual moisture content, continuously measuring the achieved residual moisture content along and across the fabric web and using the measured values obtained to control the dewatering performance at the corresponding positions on the fabric web, and by then applying an aqueous dye liquor to the partially dewatered fabric web without intermediate drying, and proportioning the amount of said liquor to be applied as a function of the measured values of the residual moisture content from the first treatment step, again measuring the moisture content of the fabric web under the same conditions as before after the application has been carried out, and also using the obtained values of the total moisture content in conjunction with the measured values of the residual moisture from the first treatment step to control the application of liquor.

A device according to German Utility Model No. 7,638,683, which also describes the engineering details, has proved suitable as an apparatus arrangement for measuring the fabric moisture in the high-moisture region, which is also able to carry out the controlling functions according to the invention, that is to say continuously monitoring (continuously measuring and also recording) and automatically controlling the dewatering (first step) or the application of liquor (second step), in the direction of the passage of the goods and across the fabric width. The measurement mentioned is carried out with the aid of a contact-free method based on microwave absorption immediately after, in the direction of the passage of the fabric, leaving a dewatering device or after a device for applying the liquor to the fabric web moving at constant speed. In this method, instantaneous moisture contents distributed across the web width are continuously measured with the aid of frequency-modulated microwaves at several measuring positions which are located side by side across the whole web width and transversely to the transport direction of the goods. Depending on the measured moisture values obtained, the dewatering performance or the quantities of liquor to be applied are individually controlled, with respect to a preset dewatering performance or quantity of liquor to be applied, by several separately adjustable sections which correspond to the measuring positions and are distributed across the width of the dewatering device or the liquor applicator device. The desired residual moisture content or the intended liquor take-up is appropriately programmed into a threshold-value circuit. In other words: in order to ensure a uniform moisture content across its width and along its length, the moist, moving textile material is subjected to a continuous moisture measurement, the measured results are recorded and used for the low-inertia control of devices which are upstream of these measuring positions and correspond to them and which maintain the dewatering performance or the quantity of liquor to be applied or which has been applied and thus, finally, the moisture content of the textile goods, across the whole width and length of the textile web, at the desired value. These processes take place in a manner such that any deviation from the moisture set point is passed on, from the measuring positions which record any such deviation, in the form of control signals to the, in each case, corresponding, upstream dewatering implements or liquor application implements of the dewatering devices or liquor applicator devices which contain several of these implements, located side by side, and which also extend transversely to the direction of passage of the web-shaped textile goods, so as to bring the moisture content of the pretreated or impregnated textile goods in accordance with the set point, virtually instantly and across the whole width. By using high-moisture measuring instruments of the type indicated after the dewatering and also controlling same with the aid of the measured values obtained and by proceeding in exactly the same manner after the application of dye liquor, a method of applying dyestuff, which is useful from the dyeing point of view, can be achieved in the process claimed, without an intermediate drying stage. In order that the two processes are uniform, narrow tolerances have to be met.

According to the present invention, the fabric web which is wet or moist from the pretreatment is adjusted to a certain residual moisture content, using a very uniformly working dewatering device, and is continuously dewatered in the manner indicated. In general, depending on the particular requirements, values of between 35 and 75% of the dry weight of the dye goods, preferably 45 to 65% by weight, of residual moisture, is aimed at. Frequently it is worth rewetting thoroughly, by passing through water, wet goods, particularly if they have been lying around for some time and their moisture has become redistributed non-uniformly, and only then proceeding with the dewatering measures.

The residual moisture which is at that instant present in the textile web is measured with the aid of the already explained microwave measuring instrument and, depending on the values thus obtained and also in accordance with the intended or required quantity of liquor to be applied in the subsequent second treatment step, the desired degree of moisture is adjusted in accordance with the reference value, which is set according to the process, by regulating the dewatering implements. A padding mangle is most frequently used for this purpose. Regulating is then effected by roller pressure.

It is important to measure the moisture continuously at several positions of the fabric web width and to use the measured values obtained to control the squeezing pressures and thus the dewatering performance of the padding mangle (or the dewatering performance of another dewatering device) over the whole width of the fabric web, in order to achieve a residual moisture content which is uniform and as low as possible in the fabric web length and the fabric web width.

The quantity of water which remains in the fabric web is important for the subsequent application of liquor.

During the course of the application phase proper, a concentrated dyestuff liquor is then padded onto this now uniformly moist fabric web, which has an exactly defined moisture content. This padding step is carried out in such a manner that afterwards the total moisture content of the dye goods is between 50 and 300%, preferably 60 to 120%, of the dry weight of the goods. The application of dye liquor thus carried out is also measured and accurately adjusted within the fixed threshold values. This regulating occurs by means of the applicator device being controlled by the moisture remaining after dewatering and the quantity of dye liquor which has to be applied necessarily, via a difference between the measured values obtained and a preset difference. As a check, another measurement is carried out after the application of dye liquor and, by renewed orientation with respect to the set value, the adjustment is carried out so that a uniform application of liquor results.

The adjustment of the quantity of liquor to be applied can be carried out manually or automatically; in the latter case, this can take the form of an electronic feedback circuit having mechanical, pneumatic or hydraulic control.

So that, when using a padding mangle as an applicator device, liquor pick-up proceeds without substantial dilution of the padding liquor (by expressed liquor flowing back into the trough)—after all, padding takes place onto the wet fabric web, the following measures are necessary:

1. The trough of the padding mangle must be small; it may have to be equipped with a displacement body.
2. Appropriately, the fabric web is nip-padded.
3. The speed of the goods must be adjusted to the requirements.
4. The padding liquor should be somewhat viscous. This is achieved by the addition of customary thickening agents. Amongst others, auxiliaries, made from polymers or copolymers of acrylamide and in the form of an aqueous solution, have proved suitable for this task. In this respect a mixture of thickening agent and acrylamide polymerization product may be advantageous.
5. Weakening of the starting liquor may have to be provided.

If other methods are used for applying the dye liquor, in particular employing applicator devices with which a certain exactly metered amount of the liquid dye preparation can be applied (for example foam application), the possibility of dilution of the padding liquor by the express liquor which is flowing back is excluded.

In the scope of carrying-out the process according to the invention, 50% by weight of additional liquor pick-up can take place, if the residual moisture present is 60% by weight, without risking the danger of a dilution of the liquor, so that the total moisture after the application of the dye liquor is 110% by weight. The rule of thumb is: the lower the residual moisture at the end of the first treatment step, the better are the conditions for the application of liquor.

Similar processes, which deal quite generally with the problem area of wet-on-wet product application on a padding mangle, have already been mentioned in Chemiefasern/Textil-industrie, Feb. 1973, page 140, and also in Textil-Praxis International, 1978/2, pages 846 et seq. In these articles the absolute requirement of a very thorough dewatering before the second impregnating step was also recognized. But practical illustrative examples of such an application method could be found in the literature only for finishing and for optical brightening. Contrastingly, the circumstances in dyeing, if, for example, in two-step methods not only aqueous solutions of nonreacting substances, but also dyestuffs, dyestuff components and also chemicals are essential ingredients of the second treatment bath, have obviously hitherto not permitted a transfer of the experiences gained in this area to the dyeing process. In particular, no detailed statements have been published concerning the question whether it is possible to dispense with the intermediate drying step still practised nowadays, after the pretreatment and, in contrast to the custom hitherto, to apply dye liquors directly onto wet fabric webs.

An explanation for the currently prevailing situation may be furnished by the state of the affairs described below: in finishing or in optical brightening, differences in the liquor pick-up of 10% by weight or more are not important for the quality of the finished product. But in a dyeing process a 10% by weight difference in the liquor pick-up can be readily seen on the fabric web thus treated; at times even smaller differences can be noticed and are therefore not acceptable. Such dyeings are of no use. Using the means and equipment available up to now it was not possible to master the tolerances which are necessary for dyeing, not only in respect of the measurement of the moisture values but also in respect of the application of liquor. Only the development of new devices has made it possible for the principle of wet-on-wet processing again to be considered for dyeing, or more exactly dyestuff application.

Measuring and controlling the dewatering provide, for the first time, in the new process the condition for a uniform application of liquor, which in earlier attempts already failed at this premise.

The new process has now succeeded in eliminating dye run-off, liquor dilution and the like.

The particular specific advantages of this new process are: difficulties brought on by incomplete rewetting of the goods, for example in padding, are eliminated, hence also certain causes of poor penetration; the danger of the goods appearing smutty is largely diminished; however, above all a drying step is dispensed with, which may lead to faulty dyeings (for example by overdrying, non-uniform drying, poor cooling-off and other faults).

Using the process according to the invention, all dyestuff classes, but also other finishing agents, can be applied to textile fabric webs of all fiber materials which are suitable for a continuous operation. They are subsequently fixed or developed by the methods customary for the products concerned, for example by simply storing at room temperature or steaming or hot air treatment and by other methods. The process claimed is therefore not restricted in this respect.

In the case of liquors being applied, it need only be borne in mind that there can be restrictions concerning the solubility of various products. This kind of fact has to be taken into account when calculating the application difference.

All necessary auxiliaries, such as, for example, alkalis, acids, leveling agents, solubilizers and others can also be added without restriction, except, possibly, in repect of their solubility and ionic character, to the liquors to be applied.

The following Examples are intended to explain the new process in more detail, in particular with respect to the number of measuring positions and regulating positions across the width of the goods, but not to restrict it in any way in this connection.

EXAMPLE 1

A cotton fabric, still wet from preceding washing steps, is expressed, on a padding mangle which is controllable across the fabric width, so as to have a 60% moisture content (calculated with respect to the weight of the dry textile goods). After the fabric has passed through the squeeze rollers, the residual moisture is measured continuously and contact-free in the middle of the fabric web and close to the two selvedges with the aid of a moisture measuring instrument of the Model AF 310 (see Textilveredlung 14, 1979, No. 5, pages 178 et seq.). Not only the total amount of moisture but also the uniformity of the same across the width of the fabric is continuously measured and, with the aid of the measured values obtained, the squeezing pressure on the padding mangle is appropriately controlled via control elements so as to give the intended preset value. A fabric web is thus obtained which is uniformly dewatered, along the length of the fabric web and across its width, so as to contain 60% by weight of moisture.

After the expressing step, the fabric web is then immediately impregnated with a dye pad bath on a second padding mangle of similar construction to the dewatering padding mangle and subsequently expressed. This dye pad bath contains, per liter of water, 160 g of the dyestuff Reactive Black 5 which has the Color Index No. 20505 (in commercially available form and state), 250 g of sodium silicate, 70 $cm^3$ of a sodium hydroxide solution (32.5% strength) and also 10 g of an auxiliary based on an acrylamide polymerization product.

The roller pressure of the padding mangle is controlled electronically/pneumatically in such a manner that after the liquor has been applied a moisture content (calculated in respect of the weight of the dry fabric) of 100% results on the textile web. This moisture content is also measured with the aid of the abovementioned moisture measuring instrument of Model AF 310, in the middle of the fabric web and close to the two selvedges. With the aid of the measured values obtained from the first and second measurement, the uniformity of the moisture on the fabric is adjusted via the control elements on the padding mangle to the intended set value of 100% by weight total moisture. A uniform application of liquor of 40% by weight in addition to the moisture already present and a dyestuff application of 64 g/kg of cotton fabric is achieved in this way.

After the padding, the fabric is wound onto a roller and is stored for 4 hours at room temperature (15°–35° C.) in order to fix the dyestuff, then the dyeing is rinsed and soaped as customary.

A deep black dyeing is obtained.

This Example is intended to show that it is possible to achieve even deep dyeings (black) with the new process of applying liquor.

EXAMPLE 2

A wet cotton fabric is passed, as in Example 1, through a padding mangle which has rollers made of a steel core and a thick porous covering layer (see Fischer-Bobsien, Internationales Lexikon Textilveredlung, 1st Continuation Volume 1975–78, under the keyword ®Roberto Walze) and is there expressed uniformly so as to have a 55% moisture content (relative to the fabric weight).

Thereafter the fabric web is impregnated in a padding bath on a second padding mangle and then expressed. The padding bath used contains, per liter of water, 30 g of the direct dyestuff of the formula

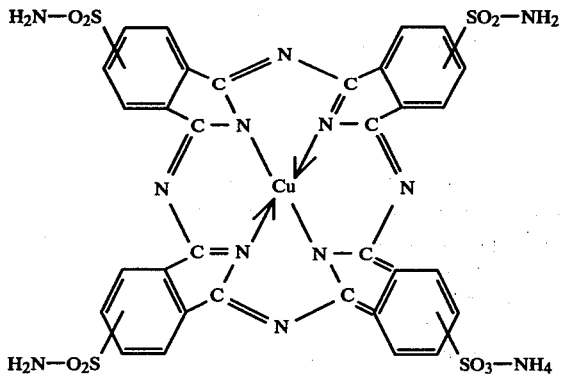

(in commercially available form and state), 10 g of a commercially available thickening agent based on carboxymethylcellulose, 20 g of butyl diglycol and 150 g of urea.

The roller pressure of the padding mangle is controlled electronically/mechanically in such a manner that after the liquor has been applied, 100% moisture content (relative to the fabric weight) results. This moisture content is also measured with the aid of the moisture measuring instrument of Model AF 310 mentioned in Example 1, in the middle of the fabric web and close to the two selvedges. The uniformity of the moisture on the fabric is adjusted with the aid of the measured values obtained from the 1st and 2nd measurement via control elements on the padding mangle so as to give the intended set value of 100% by weight total moisture. A uniform application of liquor of 45% by weight in addition to the moisture already present and a dyestuff application of 13.5 g/kg of cotton fabric are thus achieved.

After the padding, the fabric is wound onto a roller and stored for 24 hours at room temperature (15°–35° C.) to fix the dyestuff. Thereafter the dyeing is rinsed.

A perfectly level brilliant greenish blue dyeing is obtained.

EXAMPLE 3

A wet viscose fabric, which has not been dried after preceding washing steps, is expressed on a padding mangle, which can be controlled across the width of the fabric, so as to have an 80% moisture content (relative to the fabric weight). After the fabric has passed through the squeezing rollers, the moisture in the middle of the fabric web and close to the two selvedges is measured with the aid of a moisture measuring instrument of Model AF 310 (as in Example 1). Not only the total moisture but also the uniformity across the fabric width is continuously measured in this measurement and, with the aid of the measured values obtained, the squeezing pressure on the padding mangle is correspondingly adjusted so as to give the fixed set value within preset tolerances. A fabric web is thus obtained which is uniformly dewatered along its length and across its width so as to have an 80% by weight moisture content.

The fabric web is then impregnated with a padding bath at 20° C., in a nip pad on a padding mangle of similar construction to the dewatering padding mangle, and is then expressed.

The padding bath used contains, per liter of water, 40 g of the dyestuff Reactive Violet 5 of the Color Index No. 18097 (in commercially available form and state), 23 g of anhydrous sodium carbonate and 10 g of an auxiliary based on sodium alginate.

The roller pressure of the padding mangle, is manually adjusted, taking into account the measured values recorded, which are read off on a second moisture measuring instrument of the abovementioned construction, so that after the application of the liquor, 125% moisture content (relative to the fabric weight) results. The uniformity of the moisture on the fabric is adjusted by means of the measured values obtained from the 1st and 2nd measurement via control elements on the padding mangle so as to give the intended set value of 125% by weight total moisture. A uniform application of liquor of 45% by weight in addition to the moisture already present and a dyestuff application of 18 g/kg of viscose fabric is thus achieved.

After the padding, in order to fix the dyestuff, the fabric web is passed through a heating tunnel and heated to 70° C. in it. This heating tunnel is followed by a chamber in which there is a device for rolling up the fabric web (pad-roll installation). In this chamber the fabric web is rolled up and, while rotating, is maintained at an ambient temperature of 70° C. for 3 hours. After the residence period the dyed fabric is rinsed and soaped as is customary for reactive dyestuffs.

A uniform violet dyeing is obtained.

We claim:

1. A process for continuous uniform application of aqueous dye liquor to a water-wet textile fabric web, whose moisture content is measured, in the longitudinal and in the transverse direction with respect to the passage of the fabric, by microwave absorption before the application of the liquor, with an apparatus having more than two measuring positions across the width of the web, and by microwave absorption with the same apparatus after the application of the liquor, such measurement being continuous and contactfree, which process comprises partially dewatering a fabric web which is wet from a preceding wet treatment so as to give a residual moisture content, continuously measuring the achieved residual moisture content along and across the fabric web, with the aid of such measurement adjusting the dewatering operation to compensate for deviation from the uniformity of that dewatering, applying an aqueous dye liquor to the partially dewatered fabric web without intermediate drying, the amount of said liquor to be applied uniformly as a function of the measured values of the residual moisture content obtained in connection with dewatering, measuring the moisture content of the liquorcarrying fabric web by microwave absorption as defined above, and based on such measurement of the total moisture content, and on the measurement of the residual moisture content made in connection with dewatering, adjusting liquor application to compensate for deviation from uniformity in said application.

2. A process as claimed in claim 1, wherein the wet fabric web is dewatered so as to have a residual moisture content, with respect to the weight of the dry fabric, of 35 to 75%, and the application of dye liquor controlled so that the total moisture content is 50 to 300%, relative to the weight of the dry fabric.

3. A process as claimed in claim 2, in which the residual moisture content, with respect to the weight of the dry fabric, is 45 to 65%.

4. A process as claimed in claim 2, in which the total moisture content is 60 to 120% relative to the weight of the dry fabric.

5. A process as claimed in claim 1, wherein, based on the moisture measurements obtained, the application of liquor is controlled manually.

6. A process as claimed in claim 1, wherein, based on the moisture measurements obtained, the application of liquor is controlled automatically.

7. A process as claimed in claim 6, wherein either or both of dewatering and liquor application are electromechanically controlled in response to said moisture content measurements.

8. A process as claimed in claim 6, wherein either or both of dewatering and liquor application are electropneumatically controlled in response to said moisture content measurements.

9. A process as claimed in claim 6, wherein either or both of dewatering and liquor application are electrohydraulically controlled in response to said moisture content measurements.

10. A process as claimed in claim 1, wherein a thickening agent is added to the dye liquor.

11. A process as claimed in claim 1, wherein a polymer or copolymer of acrylamide is added in the form of an aqueous solution to the dye liquor.

12. A process as claimed in claim 10 or 11, wherein a thickening agent and a polymer or copolymer of acrylamide in the form of an aqueous solution is added to the dye liquor.

* * * * *